US007339128B2

(12) United States Patent
Yen

(10) Patent No.: US 7,339,128 B2
(45) Date of Patent: Mar. 4, 2008

(54) ALL-COLOR LIGHT CONTROL SWITCH

(76) Inventor: George Yen, 10F-1, 258, Lancheng Rd., Chungho City, Taipei Hsien (TW)

( * ) Notice: Subject to any disclaimer, the term of this patent is extended or adjusted under 35 U.S.C. 154(b) by 583 days.

(21) Appl. No.: 11/023,567

(22) Filed: Dec. 29, 2004

(65) Prior Publication Data

US 2006/0139907 A1 Jun. 29, 2006

(51) Int. Cl.
*H01H 9/18* (2006.01)

(52) U.S. Cl. ..... 200/314; 200/313; 200/316; 200/317; 345/170; 345/184

(58) Field of Classification Search ..... 200/308–317, 200/5 R, 4, 6 A; 341/20, 22, 35; 345/156, 345/157, 161, 160, 168–170, 172, 176, 184
See application file for complete search history.

(56) References Cited

U.S. PATENT DOCUMENTS 6,348,772 B1 * 2/2002 May ..... 200/314
6,608,271 B2 * 8/2003 Duarte ..... 200/311
6,627,829 B2 * 9/2003 Sato ..... 200/310
6,888,531 B2 * 5/2005 Ichikawa ..... 345/156
6,961,048 B2 * 11/2005 Mitchell ..... 345/168
7,105,759 B1 * 9/2006 Mucha ..... 200/310
7,141,748 B2 * 11/2006 Tanaka et al. ..... 200/310
7,205,495 B2 * 4/2007 Mazur ..... 200/316
7,222,979 B1 * 5/2007 Popowich et al. ..... 362/26

* cited by examiner

*Primary Examiner*—Michael A Friedhofer
(74) *Attorney, Agent, or Firm*—Troxell Law Office, PLLC

(57) ABSTRACT

An all-color light control switch that is used by an operator for free adjustment or control of a light emitting diode lamp set; using multiple sets of commands for light variations stored in a non-volatile memory unit in a microprocessor on the circuit board, and by switching a rotational encoder and a coaxial press knob, the operator can control the brightness and different colors of light variations of an LED lamp; special designed light guide member guides and mixes multiple-color LED light sources on the circuit and displays them on a panel.

5 Claims, 4 Drawing Sheets

ALL-COLOR LIGHT CONTROL SWITCH

BACKGROUND OF THE INVENTION

In 1879 when Edison invented the light bulb using carbon and platinum as a light filament he established another milestone of "light" for human beings. Based on the light principle invented by Edison, and many years of effort by scientists, lamp products have developed to become highly efficient light fixtures, such as tungsten filament bulbs, halogen lamp bulbs, etc. In recent years, we have seen the development of light emitting diodes; LED bulbs that demonstrate significant contribution to light sources and visual displays.

Because of high resistance to impact, extended service life, low power consumption and low heat, light emitting diodes were adopted in commercial applications in 1960, and since then, have been used in a wide variety of daily applications to include most household electrical appliances, indicator lamps and light sources for various types of instrument. In their early stages, light emitting diodes were mainly made in red color. After the Japanese Nichia Corporation declared in October 1995 that they had successfully developed high-luminosity GaInN LED having a blue light wavelength of 450 nanometers (1 nanometer=$10^{-9}$ meters) and green light wavelength of 520 nanometers, LED displays or lamp sets now have the capability of achieving an all-color objective, and the density of storage on digital audiovisual discs can be increased greatly. This was a very key breakthrough.

In recent years, mature applications of light emitting diodes have been developed to include multiple colors and high luminosity, as well as outdoor displays and variable light devices, such as color light sources for large outdoor display boards, traffic sign lamps, buildings and other three-dimensional spaces. Therefore, besides the three primary colors of red, blue and green, in terms of all-color outdoor display, variable light sources and white-light illumination, it is essential to include high-luminosity blue or green LED's, in addition to red LED's.

Obviously, in the field of light sources, the initial purpose of light has developed into an all-color world with visual effects, especially after the drastic drop of selling prices of LED's. LED devices have become the mainstream of optical and visual products. Because of its low power consumption, high luminosity and easy control of brightness, flashing effects, combination and variation of different colors by activating circuits, the LED is quite suitable for use as the medium of visual light sources.

Besides providing white light for regular light purposes, the LED is generally used to provide all-color variable light sources in indoor spaces or on outside walls. In conventional models, however, its brightness, flashing patterns and variable colors are controlled by a built-in microprocessor having the function of variable combinations; instead of being controlled by an operator to suit the actual circumstances.

Therefore, the inventor has developed the present invention of "all-color light control switch", having a control switch for the operator to freely adjust or control the LED lamp set at any time. The switch has a circuit board. Using the multiple sets of light source variation pattern commands stored in a non-volatile memory unit in a microprocessor on the circuit board, and by switching a rotational encoder, and a coaxial press knob and a multiple-color display area for up, down, left and right of the coaxial press knob, the operator is capable of controlling the brightness and light variations in different colors of the LED lamp set.

SUMMARY OF THE INVENTION

It is the objective of this invention to provide an all-color light control switch for control light emitting diode LED lamp sets, the switch having a circuit board. Because of multiple sets of light variation commands stored in a non-volatile memory unit in the microprocessor on the circuit board, switching on and off of a rotational encoder and a coaxial press knob will control the brightness and variable colors of light projecting from LED lamp set. Using light guide LED members to guide light sources from the multiple-color LED to a light guide plate, mixing them into more color variations, the design of circuit board can be simplified and its exterior design can be made more flexible.

DESCRIPTION OF THE PREFERRED EMBODIMENT

Figure 1:
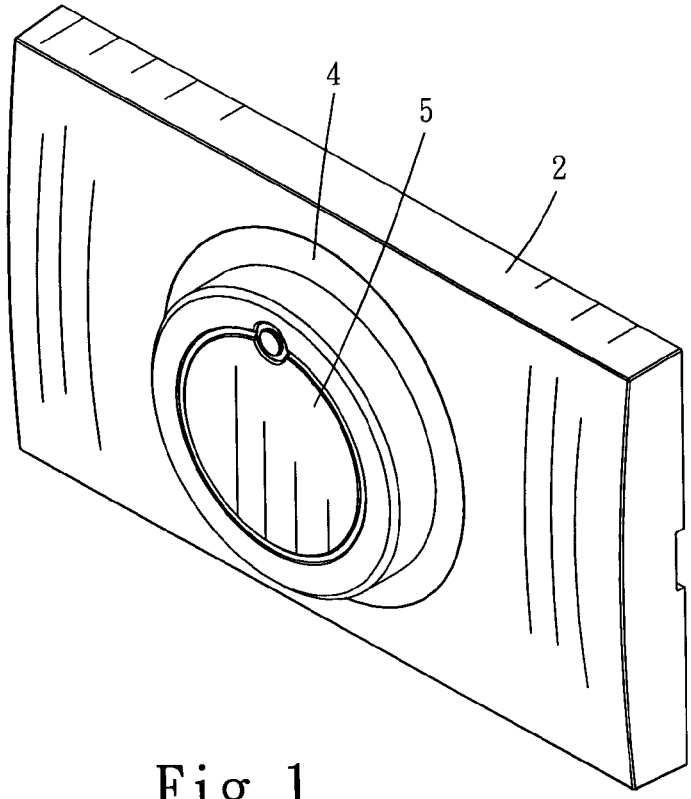
FIG. 1 is a perspective front view of the invention.
Figure 2:
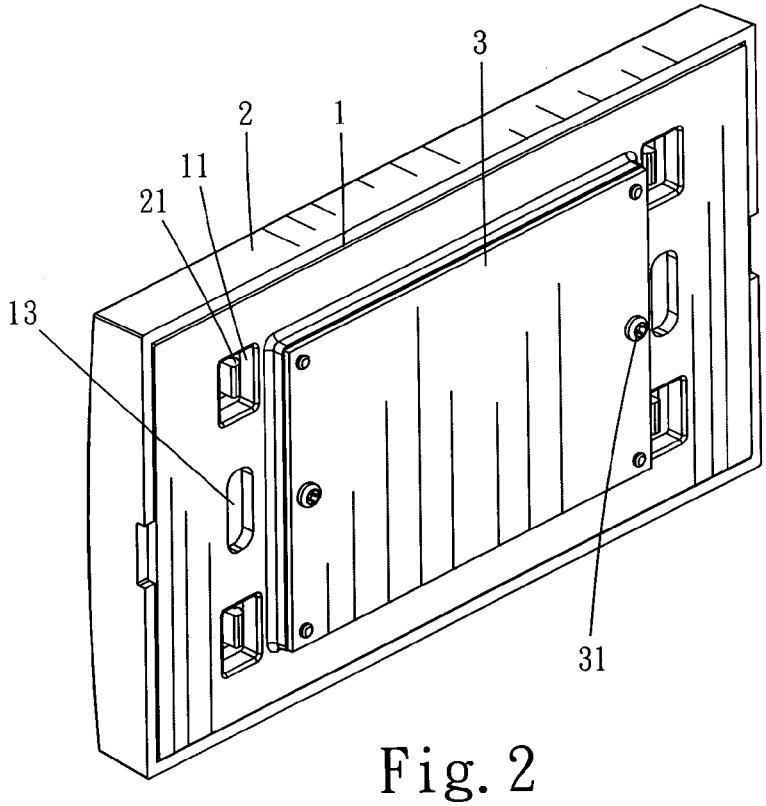
FIG. 2 is a perspective rear view of the invention.
Figure 3:
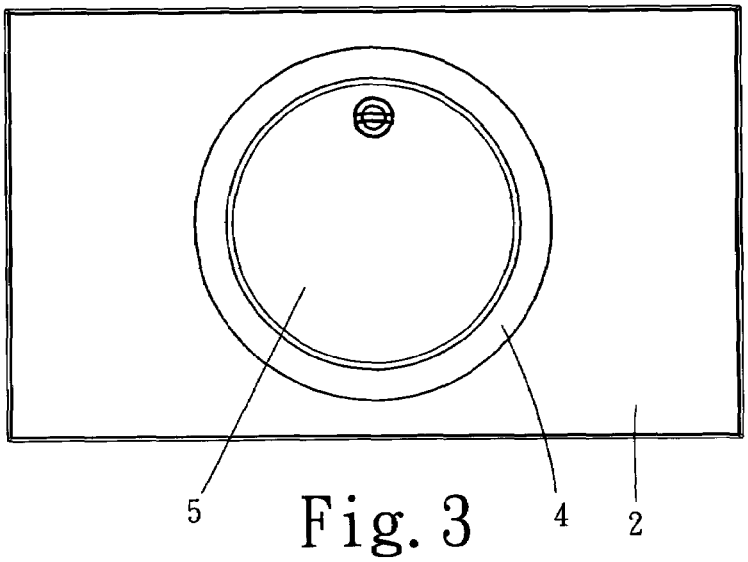
FIG. 3 is a front view of the invention.
Figure 4:
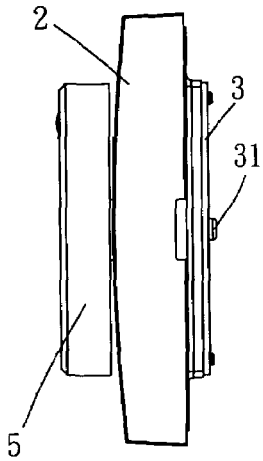
FIG. 4 is a right side view of the invention.
Figure 5:
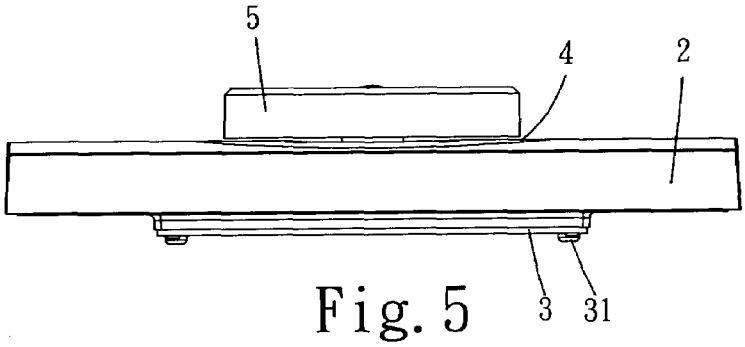
FIG. 5 is a top view of the invention.
Figure 6:
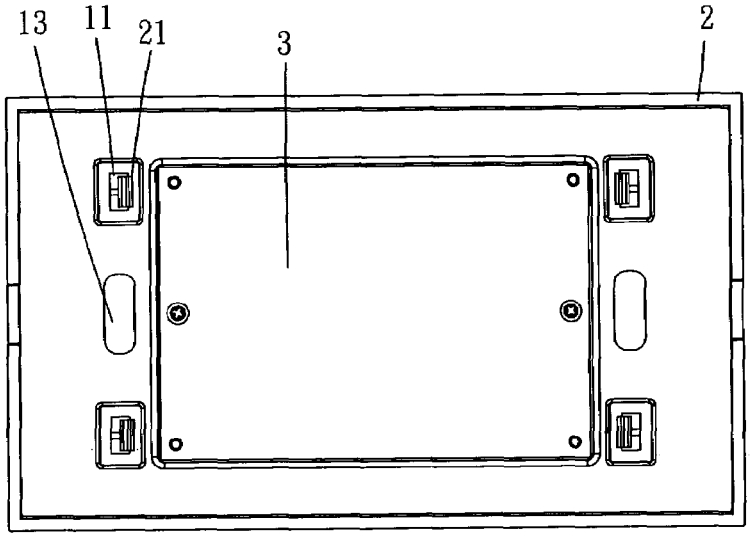
FIG. 6 is a rear view of the invention.
Figure 7:
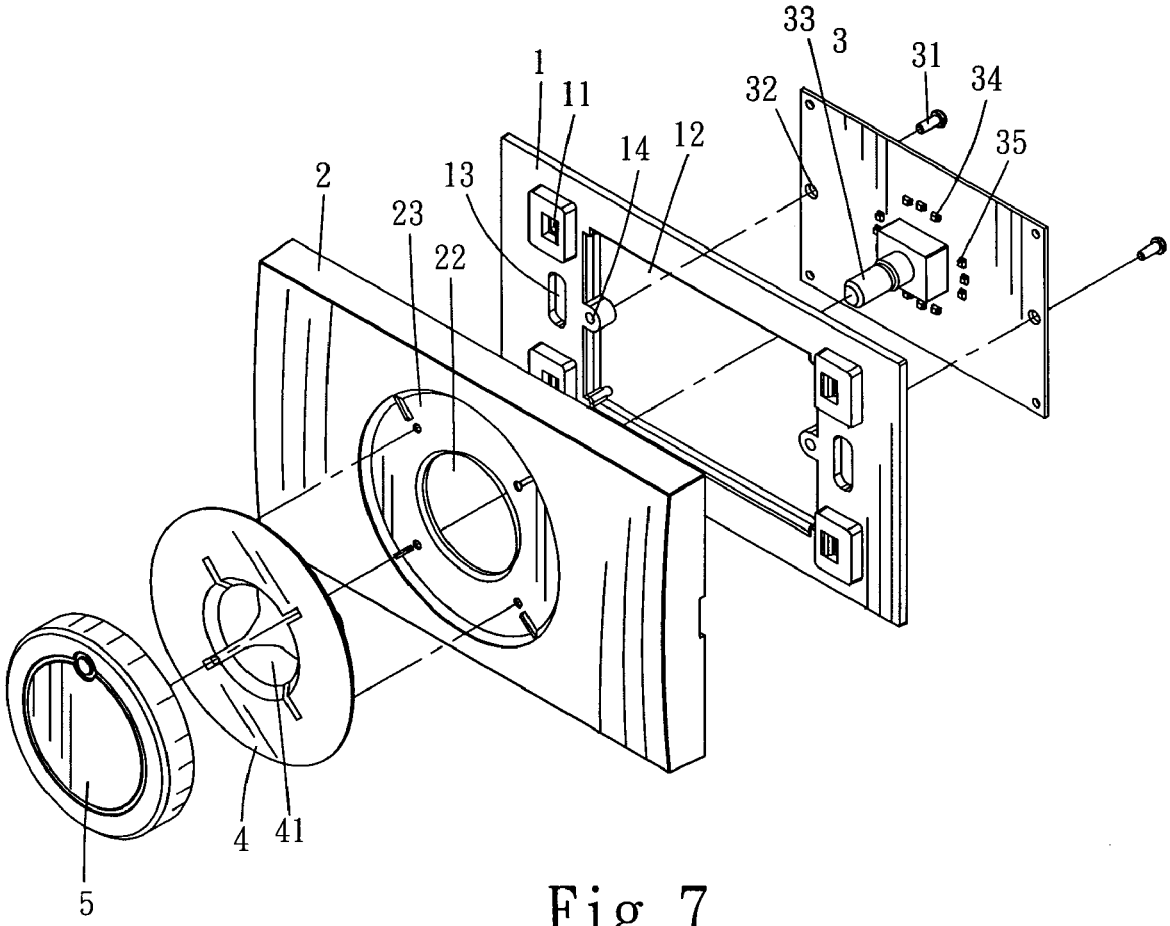
FIG. 7 is an exploded view of the invention.

The present invention of all-color light control switch includes a control center in the form of a circuit board 3, and a switch hardware unit consisting of a base plate 1, a casing 2, a circuit board 3, a light guide plate 4 and a co-axial press knob 5. The base plate 1 is combined with the casing as one unit 2 by snapping a snap hole 11 to a snap hook 21 on the casing 2. The base plate 1 has a hollow 12 and a screw hole 13 for fixing onto a wall. On two sides of the hollow 12 are screw thread units 14. On the casing 2 is a through hole 22 matching the hollow 12. On the outer periphery of the penetrating hole 22 is a ring of depressed groove 23.

The circuit board 3 is screwed onto the screw thread unit 14 by running a screw bolt 31 through a screw hole 32, thereby fixing the circuit board 3 onto the base plate 1. The circuit board 3 has a microprocessor chip, the chip containing the storage of multiple sets of non-volatile memory units of light variation instructions. The microprocessor chip circuit is connected with a coaxial switch 33 with adjustable light brightness and color variations, and multiple-set multiple-color LED sets 34, 35 distributed around the coaxial switch 33.

At the center of the light guide plate 4 is a through hole 41. On the circuit board 3 is provided a coaxial switch 33 penetrating the hollow 12 on the base plate 1, the through hole 22 on the casing, and the through hole 41 on the light guide plate 4. An end of the coaxial switch 33 is inserted in the coaxial press knob 5 at an outer edge of the casing 2, thereby the light guide plate 4 is positioned at the ring-shaped depressed groove 23 on the casing 2.

When power is started, the light sources from a specified number of multiple-color LED 34, 35 distributed on the periphery of the coaxial switch 33 are projected from the light guide plate 4.

Figure 8:
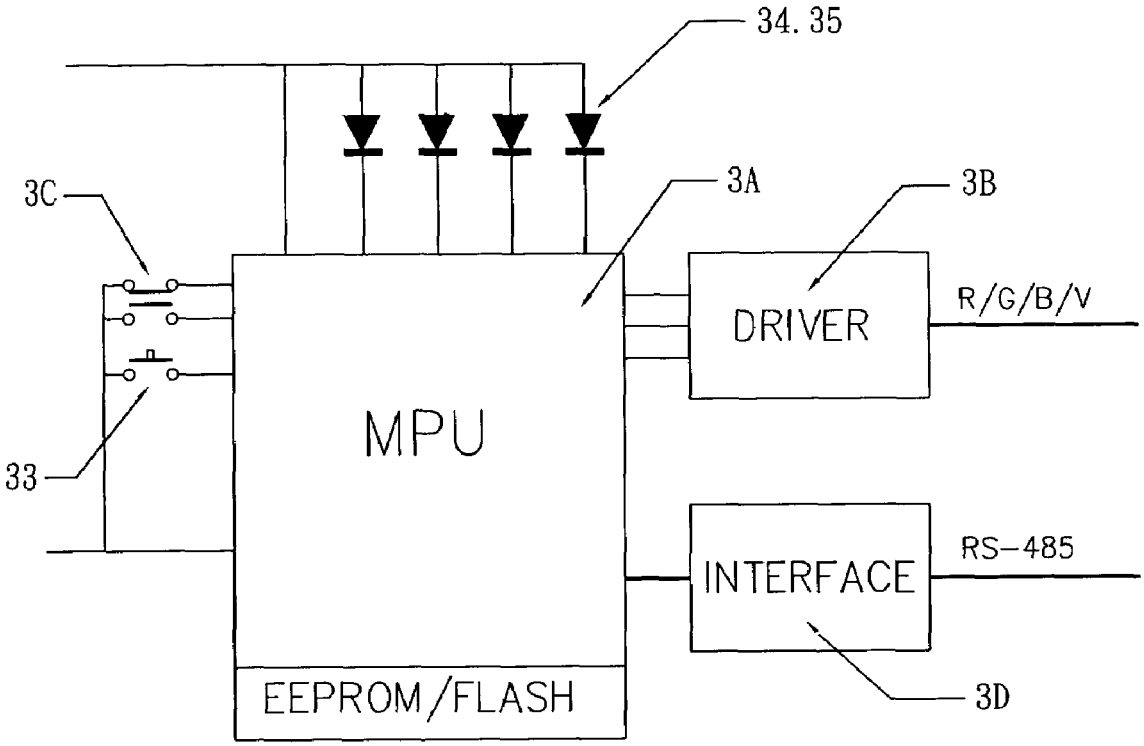
FIG. 8 is a schematic view of the device on the circuit board of the invention.

As shown in FIG. 8, the center of control for the present invention of all-color light control switch is a circuit board 3 installed on a switch hardware unit, comprising a microprocessor 3A, a sets of color light driver 3B, a rotational encoder 3C having a control coaxial switch 33, multiple sets of multiple-color LED units 34, 35 and a serial signal interface 3D. The serial signal output interface 3D transmits the signals of light variations through a specified data transmission protocol to other control units. The microprocessor 3A of the present invention translates the rotation of the rotational encoder 3C and the press/release operation of the coaxial switch 33 into color light control, using the non-volatile memory unit to record the operational status in storage to facilitate future operation.

After installing the present invention of all-color light control switch on the wall, the circuits installed at the farther ends and having different combinations and different color LED lamp set are connected to the circuit board 3 for the all-color light control switch.

Thereby, the operator can feel free to directly turn the coaxial press knob 5, using the coaxial switch 33 to adjust and control the brightness of the lamp set, or press the up, down, left or right of the coaxial press knob 5 to start flashing variations of multiple sets of multiple-color LED sets 34, 35, so that the multiple-set light variation status commands stored in the microprocessor 3A on the circuit board 3 and the LED of the non-volatile memory driver lamp set produce flashing variations or color variations.

Meanwhile, the multiple sets of multiple-color LED sets 34, 35 of the all-color light control switch, distributed on the periphery of the coaxial switch 33, project different strengths and different colors of light from the light guide plate 4.

I claim:

1. A all-color light control switch, comprising a circuit board installed in a switch hardware unit, serving as a control center, the circuit board having a microprocessor, a set of color light drivers, a rotational encoder having a co-axial switch, and multiple sets of multi-colored LED sets and serial signal interfaces; wherein the microprocessor translates rotation of the rotational encoder and press and release operation of the coaxial switch into control of color light using a non-volatile memory unit to store an operational status for controlling brightness and color variations of a far-end LED lamp set, or future operation.

2. The all-color light control switch of claim 1, wherein the switch hardware unit comprises a base plate, a casing, a circuit board, a light guide plate and a coaxial press knob; the base plate being combined to the casing as one unit by fastening a snap hole on the base plate to a snap hook on the casing, the base plate having a hollow and a screw hole for fixing the base plate on a wall, on two sides of the hollow being screw thread units, on the casing and matching the hollow being a through hole, on a periphery of the through hole being a ring-shaped recessed groove membrane, the circuit board being screwed onto the screw thread units on the base plate by running a screw bolt through the screw hole, to fix the circuit board onto the base plate, the microprocessor on the circuit board being connected with the coaxial switch for adjusting brightness of a light source from the multiple sets of multiple-color LED sets distributed on the coaxial switch, at a center of the light guide plate being a through hole, the coaxial switch installed on the circuit board being pulled into a through hole through the hollow and the casing and a through hole on the light guide plate, at an end of the coaxial switch and on an outside edge of the casing being inserted a coaxial press knob, the light guide plate being positioned on the ring-shaped recessed groove membrane on the casing, thereby an operator is free to directly rotate the coaxial press knob and by switching the coaxial switch to adjust and control the brightness of the far-end LED lamp set, or by pressing up, down, left or right of the coaxial press knob to control color variations for the far-end LED lamp set.

3. The all-color light control switch of claim 1, wherein the multiple sets of multiple-color LED sets are either one of the following, a combination of multiple sets in one single color and a combination of multiple sets in multiple colors.

4. The all-color light control switch of claim 1, wherein the rotational encoder of the coaxial press switch includes a set of light guide plates, to guide light sources from the multiple sets of multiple-color LED's on the circuit board to a light guide plate to increase flexibility of panel design.

5. The light control switch of claim 1 includes a set of serial signal output interfaces that is capable of transmitting signals of light variations through a specific transmission protocol to other control units, in addition to an all-color light driver circuit.

* * * * *